United States Patent [19]

Flint

[11] Patent Number: 4,952,068

[45] Date of Patent: Aug. 28, 1990

[54] STATIC MIXING DEVICE AND CONTAINER

[76] Inventor: Theodore R. Flint, P.O. Box 83 "Isabella Furnace", Elverson, Pa. 19520

[21] Appl. No.: 326,325

[22] Filed: Mar. 21, 1989

[51] Int. Cl.[5] ..... B01F 5/06; B01F 15/02

[52] U.S. Cl. ..... 366/337; 206/219; 366/177; 366/340

[58] Field of Search ..... 366/177, 336, 337, 338, 366/340, 602; 206/219; 222/145, 94; 215/DIG. 8

[56] References Cited

U.S. PATENT DOCUMENTS

| | | | |
|---|---|---|---|
| 582,380 | 5/1897 | Tebbutt | 215/DIG. 8 |
| 2,511,291 | 6/1950 | Mueller | 366/177 |
| 2,517,027 | 8/1950 | Rado | 222/94 |
| 2,885,104 | 5/1959 | Greenspan | 206/219 |
| 3,335,912 | 8/1967 | Reeves, Jr. | 222/94 |
| 3,423,076 | 1/1969 | Jacobs et al. | 366/337 |
| 3,623,704 | 11/1971 | Skobel | 366/337 |
| 3,696,919 | 10/1972 | Miles | 215/DIG. 8 |
| 3,746,216 | 7/1973 | Frederick | 366/340 |
| 3,866,800 | 2/1975 | Schmitt | 222/94 |
| 3,941,355 | 3/1976 | Simpson | 366/341 |
| 3,980,222 | 9/1976 | Hood . | |
| 4,093,188 | 6/1978 | Horner | 366/336 |
| 4,099,651 | 7/1978 | von Winckelmann | 222/94 |
| 4,331,264 | 5/1982 | Staar | 222/94 |
| 4,408,893 | 10/1983 | Rice, III | 336/339 |
| 4,431,311 | 2/1984 | Kolossow | 336/79 |
| 4,511,258 | 4/1985 | Federighi et al. | 366/337 |
| 4,528,180 | 7/1985 | Schaeffer . | |
| 4,538,920 | 9/1985 | Drake | 366/177 |
| 4,548,606 | 10/1985 | Larkin | 604/414 |
| 4,608,043 | 8/1986 | Larkin | 206/219 |
| 4,632,568 | 12/1986 | Emele et al. | 366/337 |
| 4,643,336 | 2/1987 | Mandeville et al. | 222/145 |
| 4,706,806 | 11/1987 | Mauthe | 206/219 |
| 4,823,985 | 4/1989 | Grollier et al. | 206/219 |

FOREIGN PATENT DOCUMENTS

| | | | |
|---|---|---|---|
| 669164 | 2/1989 | Fed. Rep. of Germany | 206/219 |

*Primary Examiner*—Timothy F. Simone

*Attorney, Agent, or Firm*—Eckert Seamans Cherin & Mellot

[57] ABSTRACT

A device for mixing plural flowable components is formed from opposing sheets of material defining a flexible multicomponent squeeze container. Seams join the perimeter of opposing sheets to form a flexible container, with at least one wall dividing the container into at least two storage compartments for the flowing components and at least one further downstream wall for mixing. External pressure on the container forces the plural components to combine in an initial mixing area along a flowpath in the container downstream of the wall dividing the compartments. The at least one further dividing wall is positioned between the initial mixing area and a container outlet. The stream of flowing material separates and then re-combines one or more times prior to exit from the container, whereby the extent of mixing is improved. The wall dividing the container into storage compartments and/or the at least one further dividing wall can be formed by adhering facing portions of flexible flat sheets together. Multiple sheets of flexible material can be utilized with suitable passage openings between layers to provide a circuitous, three-dimensional flow path to the container outlet wherein the stream of components is successively divided and recombined for thorough mixing of the flowing components.

23 Claims, 3 Drawing Sheets

STATIC MIXING DEVICE AND CONTAINER

BACKGROUND OF THE INVENTION

1. Field of the Invention

This invention relates generally to mixing devices, and more particularly to static mixing devices disposed along a flowpath fed by plural sources.

2. Description of the Prior Art

A number of static mixing devices are known in the art which have static structures partially to obstruct the flow of materials in a stream flowing through the device, whereupon the materials follow a circuitous path to effect better mixing of the materials than is possible where material from plural sources is carried along an unobstructed passage. Examples of such devices include Horner, U.S. Pat. No. 4,093,188; Emele, et al, U.S. Pat. No. 4,632,568; Federighi, et al, U.S. Pat. No. 4,511,258; Kolossow, U.S. Pat. No. 4,431,311; and Rice, III, U.S. Pat. No. 4,408,893. Static mixing devices of this type have been used in resin dispensing devices wherein the resin and a curing agent feed the plural streams, such as that disclosed by Drake, U.S. Pat. No. 4,538,920. An example employing an adhesive dispensing gun is disclosed by Mandeville, et al, U.S. Pat. No. 4,643,336. These devices are rigid in construction and not convenient for small applications. Such devices are too expensive to be economically discarded after use, and therefore the user must thoroughly clean them after each use to prevent fouling of the flow channels through the device.

Many sealants and adhesives quickly become unworkable when they begin to cure. To maximize working time, these compositions are usually prepared from reactive components mixed just prior to application. A number of known devices are intended to store reactive components separately until the time of application. The reactive components exit through a common outlet or adjacent outlets, and are thus applied together to the surface that is being treated. Examples are disclosed in Hood, U.S. Pat. No. 3,980,222; Larkin, U.S. Pat. No. 4,548,606; Rado, U.S. Pat. No. 2,517,027; Reeves, Jr., U.S. Pat. No. 3,335,912; Schaeffer, U.S. Pat. No. 4,528,180; Schmitt, U.S. Pat. No. 3,866,800; Staar, U.S. Pat. No. 4,331,264; and Von Winckelmann, U.S. Pat. No. 4,099,651. These structures, although providing a common or adjacent outlet for the components, do not adequately mix the reactive components at the outlet to ensure a complete and properly controlled reaction or, in the case of adhesives, bonding. Many of the devices are also difficult and/or costly to manufacture.

Where two streams of reactive components are simply flowed together, the proportion of components is not correct. At the junction of the component masses, the proportion, for example, of curing agent to resin is too high, causing overly accelerated curing. Away from the junction, the proportion is too low (or even zero) and curing is too slow or is absent entirely.

It would be desirable to provide a static mixing device for reactive components or any other components to be mixed, which provides a nearly homogeneous mix of the components. The optimum device would be inexpensive to manufacture and disposable such that it could be supplied with a container for the components. It would therefore be desirable to provide an inexpensive static mixing device which could be used to separately store components such as reactive components of a desired composition, and which would thoroughly mix the components prior to or during discharge for use or application. It would further be desirable to provide a static mixing device which could be readily adapted to a variety of shapes and sizes, and such a device wherein a minimum quantity of the material becomes trapped in the mixing device and therefore is unusable.

SUMMARY OF THE INVENTION

It is an object of the invention to provide an inexpensive and disposable mixing device for producing a homogeneous mix of reactive flowing components.

It is another object of the invention to provide a static mixing device which can also be used as a storage container and an applicator.

It is another object of the invention to provide a static mixing device which will store reactive components for a desired composition and discharge the components through a means that successively combines, divides and recombines a stream including the components.

It is a further object to produce mixing dispensers on standard high speed heat sealing equipment to obtain a durable and effective product at low cost.

It is yet another object of the invention to provide a static mixing device which will thoroughly mix the components of a desired composition and will discharge substantially all of the mixed volume.

These and other objects are accomplished by a static mixing device that is formed from facing flexible sheets joined together to form a multi-compartment collapsible container discharging through a combining, dividing and re-combining flowpath to an outlet. At least two storage compartments for components to be mixed to produce a desired composition are defined within the container, preferably at least partly by an internal seam joining facing portions of the flexible sheets along a line of division. Outlets are provided for each of the storage compartments such that components stored in the storage compartments can be squeezed through the outlets by the application of external pressure on the flexible container. The outlets lead to an initial mixing area where the components join into a stream. At least one further dividing wall is provided adjacent the initial mixing area to divide the stream of components flowing from the storage compartments and downstream of the further dividing wall the stream is recombined. The dividing wall is preferably also formed by fastening together facing sides of the flexible container. A container outlet can be provided in the container for discharging the stream after it has been successively combined, divided and recombined one or more times. The discharge opening can be created by cutting or tearing the flexible seam at a side edge to create a container opening.

The mixing device is preferably formed from a tube or pair of elongated sheets of the flexible material. At least one longitudinal internal seam between opposing portions of the flexible sheets is provided to divide the container into longitudinal storage compartments. More seams can be used to provide additional storage compartments, if necessary for additional components.

Outlets from the storage compartments can be provided by the absence of seams between the facing portions of flexible material at these locations. Very viscous materials can be stored in this manner without further confinement, as they will not flow out of the storage compartments unless substantial external pressure is applied to the container. A breakable seal is desirable for fluids that flow more readily, and thus could accidentally flow out of the storage compartments.

The breakable seal can be formed by a weak adhesive that joins opposing portions of the flexible sheets, or other breakable means for fastening opposing portions of the flexible sheets. The breakable seal will retain the materials within each storage compartment until sufficient external pressure is applied to the container to force the material through the seal. Alternatively, a breakable (i.e., openable) seal can be defined by a removable external clip that tightly separates one compartment area from another by clamping pressure from outside. The seal can be improved further by folding the flexible sheets together with clamping them. One available clamping device has a channel to be disposed on one side of the flexible sheets, into which the sheets are pressed by a tight fitting flange on the opposite side. To open or "break" the seal, the flange and channel are slid apart, re-joining the compartments.

Multiple layers of flexible material can be joined together to form compartments having several mixing layers. The storage compartments can be located on the same, or on different layers. The baffles can be formed, as before, by sealing or otherwise adhering opposing portions of adjacent flexible sheets. Openings or slits in the sheets provide for a flow of the components to adjacent layers of the container, and then around the baffles. A circuitous, three-dimensional flow path can thereby be established for thorough mixing of the flowing components.

The mixing device defines a flowpath at least proceeding from the separate storage areas for the reactive components or the like, to the discharge, which flowpath confines the component materials as they are combined into a stream, divided and re-combined. The flowpath can include numerous dividing walls or septums extending over part way along the path, preferably not aligned relative to one another, or alternatively, a smaller number (or even only one) of such short dividing walls or septums can be provided and the user can mix the components by squeezing the flow back and forth in both directions past the dividing wall(s) to effect successive division and re-combining for a homogeneous mix.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 6 is a perspective view of an alternative embodiment having multiple layers, partially broken away to depict internal features.

FIG. 7 is a cross section taken along line 7—7 in FIG. 6.

FIG. 8 is a cross section taken along line 8—8 in FIG. 7.

FIG. 9 is a perspective view of a second alternative embodiment having multiple layers, partially broken away to depict internal features.

FIG. 10 is a cross section taken along line 10—10 in FIG. 9.

FIG. 11 is a cross section taken along line 11—11 in FIG. 10.

DETAILED DESCRIPTION OF THE PREFERRED EMBODIMENTS

Figure 1:
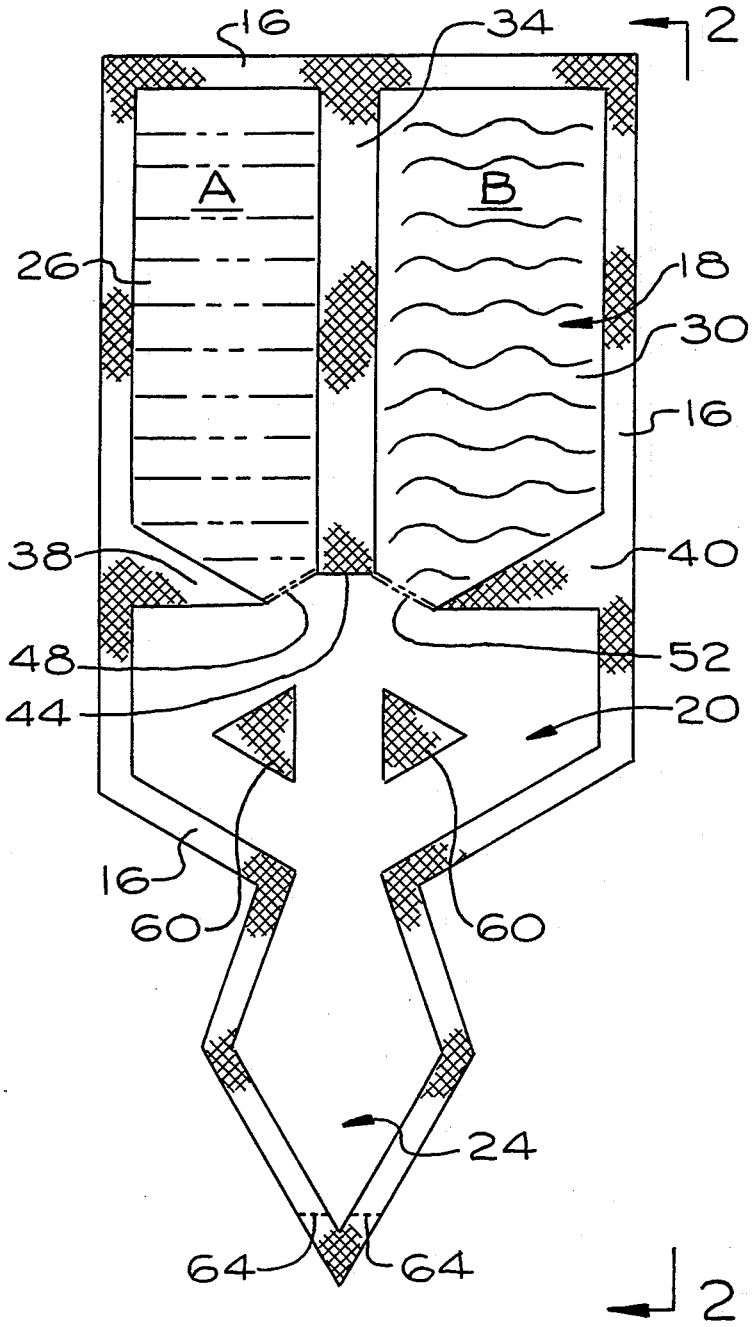
FIG. 1 is a plan view of a mixing device according to the invention.
Figure 2:
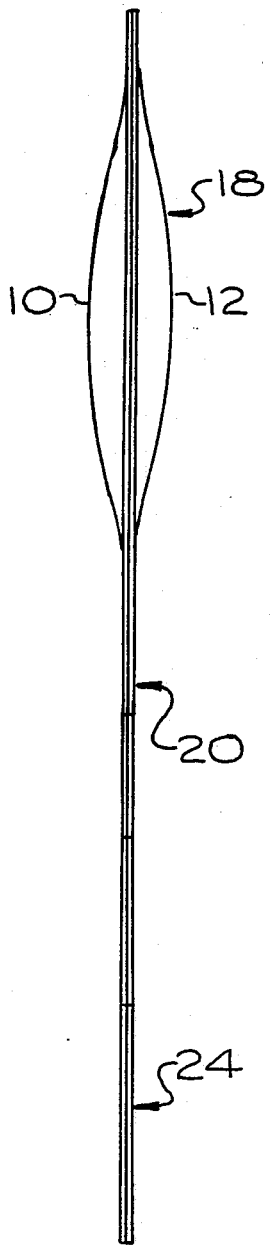
FIG. 2 is a side elevation thereof.

There is shown in FIGS. 1–4 a first embodiment of a mixing device according to the invention. The device comprises facing sheets 10 and 12 of flexible material. These sheets 10, 12 can be diametrically opposite sections of an integral tube, facing portions of a continuous folded sheet, etc. The flexible material can be transparent or translucent to permit the user to monitor the location of the contents as shown in FIG. 1. If the opposing sheets 10 and 12 are separate sheets or a folded length of one sheet they can be joined together at one or both perimeter edges by a perimeter seam 16 to form a collapsible container. The perimeter seam 16 can be formed by suitable means such as adhesives and/or heat bonding.

The container defines a storage portion 18, a mixing portion 20, and an outlet portion 24. The storage portion 18 includes two or more storage compartments such as first compartment 26 and second compartment 30. The storage compartment allows the separate storage of reactive components of a desired composition, for example, the resin and hardener of an epoxy glue. A first component A (shown in dashed lines) can be stored in the first storage compartment 26. A second component B (curved lines) can be kept in the second storage compartment 30. The first storage compartment 26 and second storage compartment 30 can be formed by the provision of compartment seam 34 that is directed inwardly from the perimeter seam 16. Non-reactive components can also be stored and mixed with the device, for example, materials to be discharged with a dye, etc. The volume of discharge from each subdivided compartment may or may not be arranged such that the mixture is properly proportioned when equal lengths of the subdivided compartments are compressed and thus emptied into the mixing area.

Side seams 38 and 40 are also run between facing sheets 10, 12. The side seams extend inwardly from the perimeter seam 16 to a point near the compartment seam 34, e.g., to the end 44 of the compartment seam 34. The space between the side seams 38, 40 and the end 44 of the compartment seam 34 defines an outlet through which the stored components A and B flow from the first storage compartment 26 and the second storage compartment 30, respectively, into the mixing portion 20.

Viscous materials will not readily flow from the first storage compartment 26 and/or second storage compartment 30 into the mixing portion 20 without substantial external pressure on the container, particularly if the containers are normally stored upright. Less viscous or randomly-stored materials may require that the outlets of the first storage compartment 26 and second storage compartment 30 be sealed. This can be accomplished by a breakable seal across each outlet such as first breakable seal 48 (shown in phantom lines) closing the outlet to the first storage compartment 26 and the second breakable seal 52 (also shown in phantom lines) which closes the outlet to the second storage compartment 30. The breakable seals 48 and 52, together with the perimeter seam 16 and dividing wall 34 retain the flowable materials within the storage compartments 26 and 30 under normal use such that they cannot combine until needed. Substantial external pressure on the container over either or both of the storage compartments causes the pressure of the fluid components to break the seal 48 or 52 as opposing portions of the flexible sheets are forced to separate and thereby allow the passage of the components into the mixing portion 20.

The breakable seals 48 and 52 can be formed by suitable means such as weak adhesives or other sealing structure which will join the opposing flexible sheet portions to seal each outlet, but which will give way with increased pressure, e.g., the user's hand pressure. The breakable seals 48 and 52 could be formed by the same process or structure which forms the perimeter seal 16, preferably heat welding or the like, but in that case the seals must be much narrower in dimension than other seams in the device to give way readily under substantial pressure. With some flexible films capable of defining a pouch, one can permanently weld layers together using a high temperature sealing device, and product a peelable seam using a lower temperature.

Components discharged from the storage compartments on either side of dividing wall 34 enter the mixing portion 20 (see arrows in FIG. 3) where the components come into contact. The mixing portion 20 comprises one or more further dividing walls or baffles that define a flow-dividing obstruction 60 along the flow path between the storage portion 18 and the outlet portion 24. As a result of the one or more obstruction(s) 60, the material flow is again divided. However, the division does not correspond to the original division of components when discharged through the breakable seals because they have now mixed at least somewhat. The one or more obstruction(s) 60 which divide the partially mixed stream are spaced downstream from the seals 48, 52 at which the components first came together. On the downstream side of the obstruction(s) 60, the separated flows are re-combined.

The successive combining and division of partially-mixed streams by means of flow dividing walls effects mixing. While the extent of mixing or the proportions of components in the respective divided streams may be uneven due to the layout of the divided paths, uneven squeezing pressure, etc., the mix becomes more homogeneous every time the flow is divided and re-combined by flow from a common area, around a flow dividing obstruction, into another common area.

The further dividing wall or walls 60 is easily formed by providing seams joining facing portions of the flexible sheets 10 and 12 at the appropriate locations. A succession of short seams can provide the necessary obstructions in the flow path of the components through the container and will thereby produce the desired mixing action. Preferably successive seams are not aligned parallel to the flowpath. Therefore, lateral flow of material occurs relative to the general flow direction, improving mixing. The dividing walls, seams or baffles 60 can be formed by the same seam-forming process that is used to form the perimeter seam 16, the compartment seam 34, and side seams 38 and 40.

Figure 3:
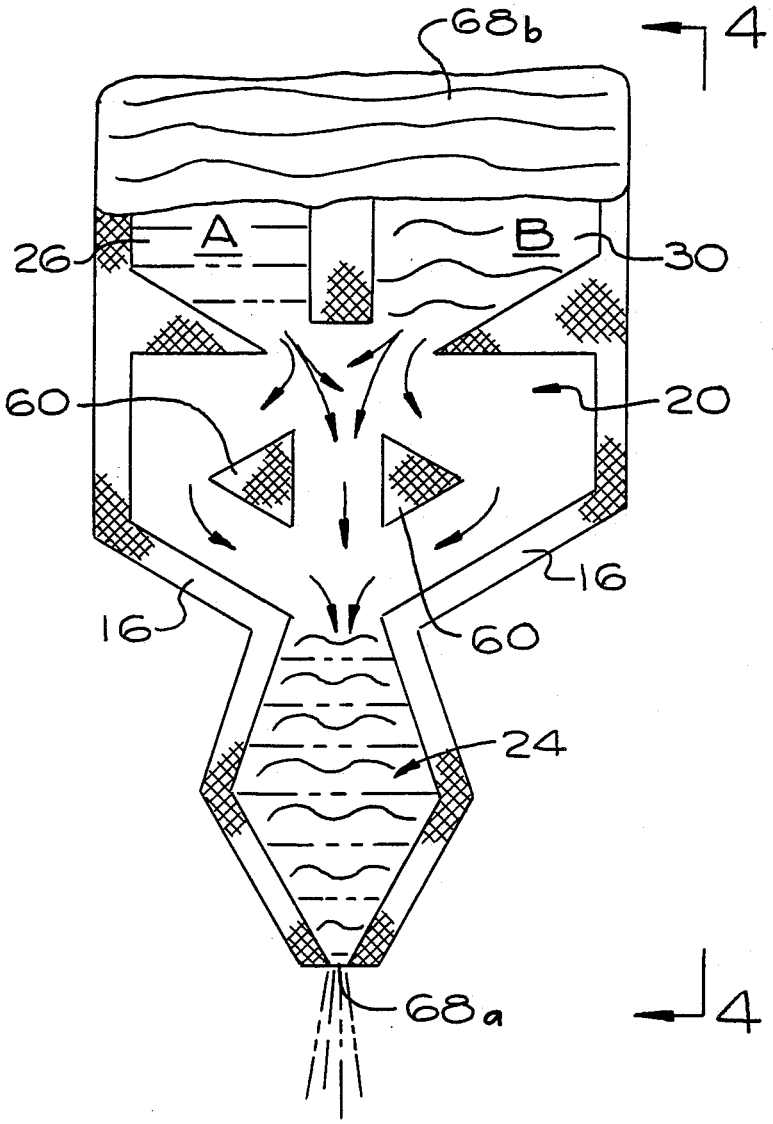
FIG. 3 is a plan view depicting schematically the operation of the device.

The path of the combined-component material in FIGS. 1 and 3 is divided into three flows following the initial mixing of components from the storage compartments. The two outer flow paths proceed substantially laterally, out and back. Material following these outer flow paths must move a longer distance then the material passing through the central path. Accordingly, should the discharge of material from the storage compartments be irregular, for example, including a momentary flow from one of the storage compartments and not the other, than downstream of the obstruction, this momentary variation in concentration will be reduced because material moving along the respective flow paths moves by unequal distances. Therefore, in addition to the eddies and vortices which occur naturally during flow and assist in mixing, the division and re-combination of flows improves the extent of mixing.

In the embodiment of FIGS. 1–4, the flow is obstructed partially by two dividing walls. It is also possible to use a single wall, or a plurality of walls as will be explained more fully hereinafter. Furthermore, with a smaller number of walls, the user can achieve the effect of a larger number of walls by working the material back and forth in both directions, prior to filling the discharge area 24.

The static mixing device of the invention can be quickly and easily manufactured, for example on standard high-speed form, fill and seal machines or on high speed pouch making equipment from rolls of heat sealable film. The flexible sheets must be formed in the desired shape and size (e.g., tube, folded sheet, facing sheets, etc.). The components are packed in the storage portion 18, and the seams must be formed by heat bonding, adhesive bonding or other suitable means. The entire process requires only a few steps and can be set up on a production line, producing a static mixing dispenser that is inherently inexpensive, especially as compared to alternative mixing devices.

The outlet portion 24 can be provided by any means suitable for defining an exit for flow of the material from the container. A receptacle area at the outlet could be omitted from the container and a material exit path formed by the user at the point of application by tearing or cutting an opening through the perimeter seam 16 or through one of the flexible sheets 10 and 12. A scribe cut 64 can be provided through the perimeter seam 16 to assist the user in tearing an appropriate material outlet. Other outlet structure is possible.

The outlet portion 24 preferably is formed as an applicator such as the diamond-shaped applicator of FIG. 1, which defines a receptacle area adjacent the discharge. During mixing the material can be squeezed into and back out of the applicator, in each case passing over mixing obstruction 60, whereby the flow is divided and re-recombined. The applicator is a constricted portion of the container as compared to storage area 18 which is more easily grasped between the fingers so that the user may confine squeezing pressure to the outlet area and more easily and accurately direct the application of the mixed components. The diamond-shaped applicator can be formed by suitably shaping the opposing sheets of flexible material 10 and 12. The user can thereby squeeze the applicator at one end of the diamond to isolate the material in the applicator, whereupon squeezing forces the material through the outlet at the other end of the applicator.

Figure 4:
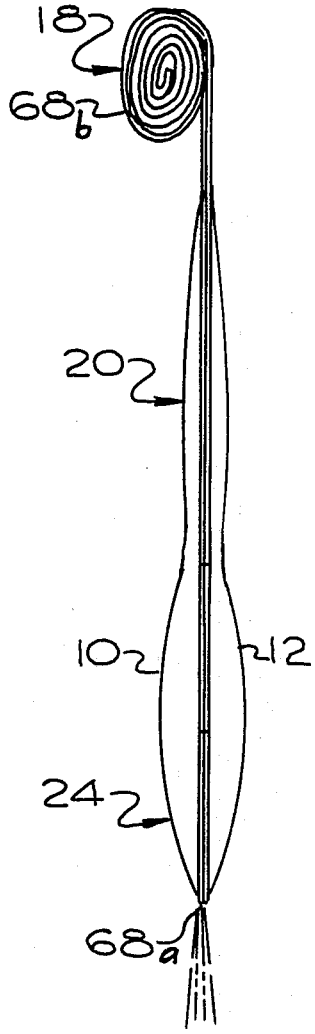
FIG. 4 is a side elevation of the view of FIG. 3.

Operation of the mixing device is depicted in FIGS. 3–4. External pressure is applied to the storage portion 18 over one or both of the storage compartments 26 and 30. The fluid pressure of the first component A and second component B will rise in the storage compartments 26 and 30 until the breakable seals 48 and 52 give way. The compartment dimensions and/or the concentrations of active materials in the compartments can be set such that by squeezing a required length for the volume of material needed the nominal proportions are provided. Alternatively, the user can choose to vary the proportion by squeezing out a different proportion. In this manner the user can vary the working time (for epoxy and curing agent) or color (for material and dye), etc. Varying the working time of a mixture of resin and curing agent in this manner is not usually recommended. An important benefit of the present invention is that the package can be arranged such that the adjacent compartments have the proportionately correct ratio that by squeezing out the same length, the correct ratio of components is mixed.

The components A and B flow due to pressure collapsing enclosures 26, 30, from the storage compartments (arrows in FIG. 3) into the mixing portion 20. The flow of the components A and B across the mixing portion 20 to the outlet area 24 will be interrupted by the baffles 60, dividing the flow into at least two streams. The two components A and B mix in each divided flow section as a result of the irregularities of flow along defined paths around the baffles 60. Eddies, vortices, slip planes, diffusion, etc., all lead to mixing. These effects will be different for the individual divided flows, and the length of travel for the individual flows can be different as well, all leading to further mixing as the flows pass over the obstructions. One level of obstructions 60 are provided in the embodiment shown. Additional levels can also be provided, with short septums disposed to divide flow, and the flow re-combining downstream before encountering another flow-dividing septum. Whether there are plural divisions or only one, the effect of plural divisions/combinations can be obtained by passing the flow back and forth over the obstructions 60. The resulting composition ultimately reaches the outlet portion 24 thoroughly mixed. All or only a portion of the mixture can be accumulated in the outlet portion 24 and forced through the opening 68 by applying pressure to the outlet portion 24 after pinching off the inlet thereto. The location, character and amount of material placed onto the work can thereby be carefully controlled using this inexpensive storage/mixing/applying device.

The flexible storage portion 18 can be tucked tightly into a roll **68*b* as shown in FIG. 4, to force the components A and B from the respective storage compartments 26 and 30 in even amounts as the roll proceeds. Alternatively, a roller (not shown) can be applied to the container to employ compartments 26, 30 into the mixing area. Such a roller is also very useful for forcing the material back and forth over obstructions 60** to effect mixing.

Figure 5:
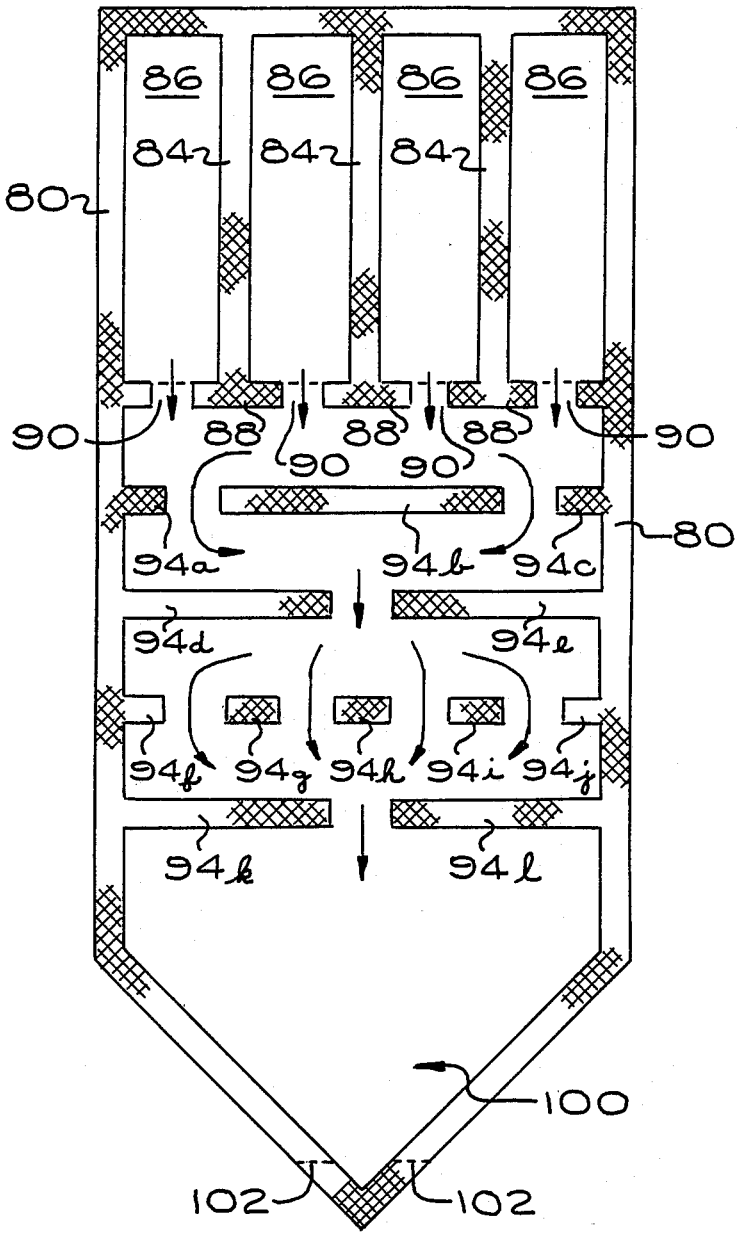
FIG. 5 is a plan view of an alternative embodiment.

The invention is capable of several alternative forms. One such form employing a plurality of storage compartments and mixing obstructions is shown in FIG. 5. The perimeter seam 80 is used to join opposing sheets of flexible material as previously described. Plural longitudinal compartment seams 84 are used to form multiple compartments 86 for a multi-component material. End seams 88 abut the compartment seams 84 and are discontinuous so as to leave outlets 90 for the components to exit the storage compartments 86. Baffles **94-*a* through 94-*l* direct components from the storage compartments 86 through tortuous paths of divisions and recombinations, of varying lengths, the paths being indicated by the arrows in FIG. 5. The multi-directional varying length dividing and recombining flow paths of the components result in thorough mixing of the components before they reach an outlet portion 100. For even better mixing, the material can be worked back and forth over one or both obstruction levels. The outlet portion 100 can be formed as previously described and can be provided with structure to facilitate the creation of an outlet opening, such as the scribe cuts 102 formed in the perimeter seam 80. The outlet portion 100 also has an easily pinched-off inlet, defined between seam sections 94-*k* and 94-*l***.

The invention allows the formation of alternative designs by altering the shape of the flexible sheets and the arrangement of the seams. The seams of the storage compartment could be positioned irregularly to correctly size the storage compartments so as to meter proportionate volumes of reactive or other components to the outlet. The number and design of the obstructions or baffles can similarly be easily adjusted by the appropriate placement of appropriate seams. Due to variations in the viscosity of materials to be mixed more or fewer baffles may be appropriate to ensure adequate mixing. The outlet portion 24 can also be easily modified by the provision of suitable seams and by alterations to the corresponding portions of the flexible sheets 10 and 12.

The foregoing embodiments of the invention perform the mixing of the component materials in a single planar level defined between two facing sheets of the flexible material. It is also possible to mix the components between a rigid sheet or body and a single flexible sheet, or at multiple planes. For multiple planes, three or more layers, of which all but one are a flexible material, are provided. Suitable slits or openings are formed in intermediate flexible sheets to provide for flow of the components between the respective layers. Portions of adjacent sheets at each level are adhered together as before, or the openings between layers are configured, to form flow-dividing baffles which mix the components together as they flow around the baffles. The plural layers of baffled mixing chambers provide for a circuitous, three-dimensional flow path which thoroughly mixes the components prior to reaching the outlet. Preferably, the flow through the compartments proceeds continuously from the storage compartment at one end to the outlet at the other end, whereby the container is simply squeezed or rolled to effect mixing and discharge. This can be varied, however, particularly where an intermediate rigid layer is provided. A circuitous path can also be used to permit addition of further component materials at an intermediate point between the initial mixing of components and the ultimate discharge. The further component can be an optional one, for example a thixotropic agent.

A suitable three-dimensional static mixing device is shown in FIGS. 6–8. The container includes a storage portion 130, a mixing portion 134, and an outlet portion 138. The container is formed from three flexible sheets such as the top sheet 140, middle sheet 142, and bottom sheet 144. One of these sheets could be rigid, however, it is presently preferred that each sheet be of the same flexible material. The flexible sheets, as before, are adhered together at a perimeter seam 150, while other seams are utilized to form compartments and baffles within the container. A longitudinal seam 154 adheres opposing portions of the top sheet 140 and bottom sheet 144 to form storage compartments 158, 160 for the first components for the desired composition. Side seams 162, 164 substantially enclose the storage compartments 158, 160, respectively. The components flow as shown by arrows in the figures, out of openings 166, 168 between the side seams 162, 164 and the longitudinal seam 154. Materials flow out of the storage compartment 158, 160 through the openings 166, 168, respectively, when external pressure is applied to the storage portion 130 of the container.

The components leaving the storage compartments 158, 160 flow into a first mixing chamber 172 that is formed by the side seams 162, 164 and by a lateral seam 174 between the top sheet 140 and the middle sheet 142. The component flows combine and begin to mix in the first mixing chamber 172, which mixing can be improved by kneading. The components flow out of the first mixing chamber 172 through an opening 176 in the middle sheet 142. The components flow downward into a second mixing chamber 180, where the mixed components are divided and re-combined.

The second mixing chamber 180 is formed by rear lateral seam 181 and a front lateral seam 182 between the middle sheet 142 and the bottom sheet 144. A flow-dividing baffle 184 is provided by a suitable internal seam between the middle sheet 142 and the bottom sheet 144, such that the components flowing through the second mixing compartment 180 will flow around the baffle 184 to continue to mix the diverse components. Downstream of the baffle, the flows re-combine. The material can be worked back and forth if desired. An opening 188 in the middle sheet 142 allows the materials to pass upwardly from the second mixing chamber 180 to a third mixing chamber 192. The third mixing chamber 192 is formed between the top sheet 140 and the middle sheet 142 by the lateral seam 174 at the rear and by side end seams 193, 194. The now-thoroughly-mixed components leave the third mixing chamber 192 through an opening 196 between the end seams 193, 194, which opening directs the components through a nozzle 200 and a nozzle opening 202.

A second multiple sheet embodiment of the invention is depicted in FIGS. 9–11. The mixing device, as previously described, also includes a storage portion 220, a mixing portion 224, and an outlet portion 228. The second multiple sheet embodiment is also formed from adhered sheets of the flexible material, here the top sheet 232, middle sheet 236, and bottom sheet 240. In this embodiment the storage and the mixing are both multiplanar. A plurality of flow-dividing obstructions producing eddies, varied path lengths, vortices, slip planes and the like are encountered as the material proceeds from storage to outlet.

The space in the storage portion 220 between the top sheet 232 and the middle sheet 236 forms an upper, first storage compartment 244. The space in the storage portion 220 between the middle sheet 236 and the bottom sheet 240 forms a lower, second storage compartment 246. Upper compartment interior seams 250 are provided between the upper sheet 232 and the middle sheet 236 to form outlet openings 252 for the upper storage compartment 244. Lower compartment interior seams 254 are formed between the middle sheet 236 and the bottom sheet 240 to form lower compartment openings 256 for the lower compartment 246. The components flow out of the storage compartments 244, 246 through the respective outlet openings to 252, 256 in the direction depicted by the arrows in the figures.

The upper storage compartment 244 communicates directly with a first mixing chamber 260 through the outlet openings 252. The lower storage compartment 246 is closed at its forward end by a lateral seam 264 between the middle sheet 236 and the bottom sheet 240. An opening 262 is provided in the middle sheet 236 adjacent to the lateral seam 264. Flow from the lower storage compartment 246 is thereby directed upward through the opening 262 into the first mixing chamber 260, where it joins the component from the upper storage chamber 244. The respective components flow around a baffle 268 formed by adhered interior portions of the upper sheet 232 and the middle sheet 236 so as to continue to mix the components.

The first mixing chamber 260 is closed at its downstream end by a lateral seam 272 between the top sheet 232 and the middle 236. An opening 276 in the middle sheet 236 directs flow from the first mixing chamber 260 to a lower, second mixing chamber 280. Flow through the second mixing chamber 280 travels around side baffle seams 282 formed by adhered portions of the middle sheet 236 and the lower sheet 240. The side baffle seams 282 leave a central opening 284 for the passage of the flowing materials. The lower, second mixing chamber 280 is sealed at the downstream end by a lateral seam 286 between the middle sheet 236 and the lower sheet 240. An opening 290 in the middle sheet 236 permits the upward flow of the materials into an upper, third mixing chamber 292. The thoroughly mixed materials flow out of the mixing chamber 292 through an outlet opening 296 and into a nozzle 300. The components leave the nozzle 300 through a nozzle opening 302.

The invention as so disclosed is a static mixing device for at least two components A and B of a composition, comprising a collapsible container with at least two facing sheets 10, 12; 150, 154; 232, 236, 240, etc., at least one of the facing sheets being flexible; a storage portion 18, 130, 220 in said container having walls defining at least two storage compartments 26, 30; 158, 160; 244, 246 for said components, said storage compartment having compartment outlets 48, 52; 166, 168; 252, 262 and, a mixing portion 20, 134, 224 of said container communicating with said storage compartments through said compartment outlets, said mixing portion having at least one obstruction 60, 184, 250, 268 formed by fastened together opposing portions of said facing sheets, said obstruction being positioned relative to said storage compartment outlets along a flow path between the compartment outlets and an outlet 68, 202, 302 of the collapsible container such that flow from the storage compartments combines upstream of the obstruction along the flowpath, divides at the obstruction, and re-combines downstream of the obstruction, whereby upon squeezing the device said components exit said storage compartments through said storage compartment outlets and are mixed together along the flowpath to the outlet.

The storage compartments can be formed at least partly by at least one compartment seam 34, 154, 236 fastening opposing portions of said facing sheets, said compartment outlets being formed by discontinuous portions 38, 40, 166, 168, 252, 262 of said seam. An outlet receptacle 24, 142, 138, 236, 228 can be provided adjacent said outlet of the collapsible container, said outlet receptacle can be defined by a constricted portion 16, 196, 296 of said collapsible container with a tip portion 24, 138, 228, said mixing portion being positioned between said storage compartments and said outlet. The outlet can be formed by a scored part 64 of the outlet receptacle for removal of a tip portion of said constricted portion to open the outlet 68*a*. Preferably, the storage compartment outlets are sealed by breakable seals 48, 52 for releasably adhering opposing portions of said facing sheets to one another at said storage compartment outlets.

The facing sheets are preferably elongated and said storage compartments are formed by at least one longitudinally-directed compartment seam 34, 154, 236. The outlet receptacle 24 can be substantially diamond-shaped and thereby easily pinched off at a narrow inlet thereto.

The static mixing device can have first and second exterior sheets and at least one intermediate sheet 154, 236 positioned at least in part between said exterior sheets, to define said facing sheets on two or more levels. At least one of each adjacent pair of said sheets is flexible, the sheets defining adjacent flow paths. At least one obstruction along the paths is formed by a respective seam between opposing portions of the sheets in the adjacent pairs. Openings in the intermediate sheet 154, 236 define a path for flow between the adjacent flow paths to provide a circuitous, three-dimensional path for mixing the components. Portions of said facing sheets can be adhered to opposing portions of other said facing sheets across respective lateral widths thereof, to form lateral seams 38, 40; 162, 164; 174; 268; 272; etc., defining at least one mixing chamber. Openings 176, 188; 262, 276, 290 in the intermediate sheet provide for direct flow between adjacent mixing chambers. The storage compartments can be formed partly by a central longitudinal seam between opposing portions of said sheets. The storage compartments may comprise a first storage compartment formed between said first exterior sheet and an intermediate sheet, and a second storage compartment 246 formed between an intermediate sheet and said second exterior sheet, and further storage compartments can be formed by the provision of additional intermediate sheets.

The static mixing device as disclosed has at least one baffle, said baffle preferably comprising fastened-together opposing areas 60 of said flexible sheets and being positioned along a flowpath defined between said outlets of said storage compartments and said outlet means of said mixing portion, the flowpath from the storage compartments combining the components and the at least one baffle dividing and re-combining flow of the components whereby diverse components stored in the storage compartments and thereafter forced through said compartment outlets are thoroughly mixed with one another prior to exit through said outlet means. Side seams on the device are inwardly directed from said perimeter seam and have inside ends, said inside ends being substantially adjacent to said compartment seam, said space between said inside ends of said side seams and said compartment seam defining the compartment outlets and preferably being defined by means releasably adhering opposing portions of said flexible sheets at said compartment outlets.

The storage compartments can include a first storage compartment formed between said first sheet and one of said intermediate sheets, and a lower storage compartment formed between one of said intermediate sheets and said second sheet.

The foregoing multi-layered embodiments of the invention are but two examples of the several alternative designs which are possible to thoroughly mix diverse components through a circuitous, three-dimensional path characterized by obstructions dividing and re-combining the flow. It will be apparent to one skilled in the art that several other embodiments and modifications are possible without departing from the spirit or essential attributes of the invention and accordingly, reference should be had to the following claims rather than to the foregoing specification, as indicating the scope of the invention.

I claim:

1. A static mixing device for at least two components of a composition, comprising:

a collapsible container with at least two facing sheets, at least one of the facing sheets being flexible;

a storage portion in said container having walls defining at least two storage compartments for said components, said storage compartment having compartment outlets; and, a mixing portion of said container communicating with said storage compartments through said compartment outlets, said mixing portion having at least one obstruction formed by fastened opposing portions of said facing sheets, said obstruction being positioned relative to said storage compartment outlets along a flow path between the compartment outlets and an outlet of the collapsible container such that flow from the storage compartments combines upstream of the obstruction along the flowpath, divides at the obstruction and recombines downstream of the obstruction, whereby upon squeezing the device said components exit said storage compartments through said storage compartment outlets and are mixed together along the flowpath to the outlet.

2. The static mixing device of claim 1, wherein said storage compartments are formed at least partly by at least one compartment seam fastening opposing portions of said facing sheets, said compartment outlets being formed by discontinuous portions of said seam.

3. The static mixing device of claim 1, further comprising an outlet receptacle adjacent said outlet of the collapsible container, said outlet receptacle being defined by a constricted portion of said collapsible container with a tip portion, said mixing portion being positioned between said storage compartments and said outlet.

4. The static mixing device of claim 3, wherein said outlet is formed by a scored part of the outlet receptacle for removal of a tip portion of said constricted portion.

5. The static mixing device of claim 2, wherein said storage compartment outlets are sealed by breakable seals.

6. The static mixing device of claim 5, wherein said breakable seals comprise a means for releasably adhering opposing portions of said facing sheets to one another at said storage compartment outlets.

7. The static mixing device of claim 2, wherein said facing sheets are elongated and said storage compartments are formed by at least one longitudinally-directed compartment seam.

8. The static mixing device of claim 3, wherein said outlet receptacle is substantially diamond-shaped.

9. The static mixing device of claim 1, wherein said facing sheets comprise first and second exterior sheets, said device further comprising at least one intermediate sheet positioned at least in part between said exterior sheets, at least one of each adjacent pair of said sheets being flexible, the sheets defining adjacent flow paths, and at least one obstruction being formed by a respective seam between opposing portions of the sheets in the adjacent pairs, openings in the intermediate sheet defining a path for flow between the adjacent flow paths to provide a circuitous, three-dimensional path for mixing the components.

10. The static mixing device of claim 9, wherein portions of said facing sheets are adhered to opposing portions of other said facing sheets across respective lateral widths thereof, to form lateral seams defining at least one mixing chamber, openings in the intermediate sheet being provided to direct flow between adjacent mixing chambers.

11. The static mixing device of claim 9, wherein said storage compartments are formed partly by a central longitudinal seam between opposing portions of said first and said second exterior sheets.

12. The static mixing device of claim 9, wherein said storage compartments comprise a first storage compartment formed between said first exterior sheet and an intermediate sheet, and a second storage compartment formed between an intermediate sheet and said second exterior sheet, and whereby further storage compartments can be formed by the provision of additional intermediate sheets.

13. A static mixing device, comprising:

opposing sheets of flexible material, said opposing sheets being joined at a perimeter thereof by a perimeter seam to form an enclosed flexible container;

at least one compartment seam directed inwardly from said perimeter seam and defining at least two storage compartments with compartment outlets;

a mixing portion of said container communicating with said storage compartments through said compartment outlets, said mixing portion having outlet means and at least one baffle, said baffle comprising fastened-together opposing areas of said flexible sheets and being positioned along a flowpath defined between said outlets of said storage compartments and said outlet means of said mixing portion, the flowpath from the storage compartments combining the components and the at least one baffle dividing and re-combining flow of the components whereby diverse components stored in the storage compartments and thereafter forced through said compartment outlets are thoroughly mixed with one another prior to exit through said outlet means.

14. The static mixing device of claim 13, further comprising side seams on the device, said side seams being inwardly directed from said perimeter seam and having inside ends, said inside ends being substantially adjacent to said compartment seam, said space between said inside ends of said side seams and said compartment seam defining said compartment outlets.

15. The static mixing device of claim 13, wherein said compartment outlets are sealed by breakable seals.

16. The static mixing device of claim 15, wherein said breakable seals are defined by means releasably adhering opposing portions of said flexible sheets at said compartment outlets.

17. The static mixing device of claim 13, wherein said outlet means comprise means for creating an opening in at least one of said flexible sheets and said perimeter seam, said at least one baffle being positioned between said outlet means and said storage compartment outlets.

18. The static mixing device of claim 13, wherein said opposing flexible sheets comprise first and second exterior sheets, and further comprising at least one intermediate flexible sheet positioned at least in part between said opposing exterior sheets, said intermediate sheet defining adjacent flow paths with said exterior sheets, said baffles each being formed by adhered portions of said intermediate sheet with portions of one of said first and second exterior sheets or other intermediate sheets, openings in said intermediate sheet being provided to permit flow between said adjacent flow paths, whereby said components will travel through said openings between said adjacent flow paths, and around said baffles, to thoroughly mix said components.

19. The static mixing device of claim 18, wherein portions of adjacent sheets are adhered across the respective lateral widths to form at least a one mixing chamber, openings in the intermediate sheets being provided to direct flow between any adjacent mixing chambers.

20. The static mixing device of claim 18, wherein said storage compartments are formed by a central longitudinal seam between opposing portions of said first exterior sheet and said second exterior sheet.

21. The static mixing device of claim 18, wherein said storage compartments comprise a first storage compartment formed between said first sheet and one of said intermediate sheets, and a lower storage compartment formed between one of said intermediate sheets and said second sheet.

22. In a collapsible container formed from facing sheets of material of which at least one said facing sheet is flexible, and having plural storage compartments within said collapsible container leading to storage compartment outlets for directing diverse components stored in said storage compartments to a container outlet, the improvement comprising:

at least one obstruction positioned along a flow path defined between said storage compartment outlets and said container outlet, said obstruction being formed by adhered opposing portions of said flexible sheets and said obstruction being spaced from the compartment outlets and from said container outlet, whereby upon collapsing the container the diverse components combine into at least one flow upstream of the at least one obstruction, the at least one flow is divided into plural flows by the at least one obstruction, and the plural flows recombine downstream of the obstruction, effecting mixing of the diverse components.

23. The collapsible container of claim 22, wherein said device comprises at least one intermediate sheet positioned between said facing flexible sheets, said intermediate sheet defining adjacent flow paths, said at least one obstruction being formed by adhered portions attaching said intermediate sheet to portions of one of said facing sheets and others of said intermediate sheets, openings in said intermediate sheets being provided to permit flow between said adjacent flow paths, whereby said materials will travel through said openings between said flow paths, and around said obstruction, to thoroughly mix said components.

* * * * *

UNITED STATES PATENT AND TRADEMARK OFFICE

CERTIFICATE OF CORRECTION

PATENT NO. : 4,952,068

DATED : August 28, 1990

INVENTOR(S) : Theodore R. Flint

It is certified that error appears in the above-indentified patent and that said Letters Patent is hereby corrected as shown below:

The 4 sheets of drawings consisting of Figs. 6, 7, 8, 9, 10, and 11 should be added as shown on the attached sheets.

Signed and Sealed this

Seventh Day of June, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,952,068

DATED : August 28, 1990

INVENTOR(S) : Theodore R. Flint

It is certified that error appears in the above-indentified patent and that said Letters Patent is hereby corrected as shown below:

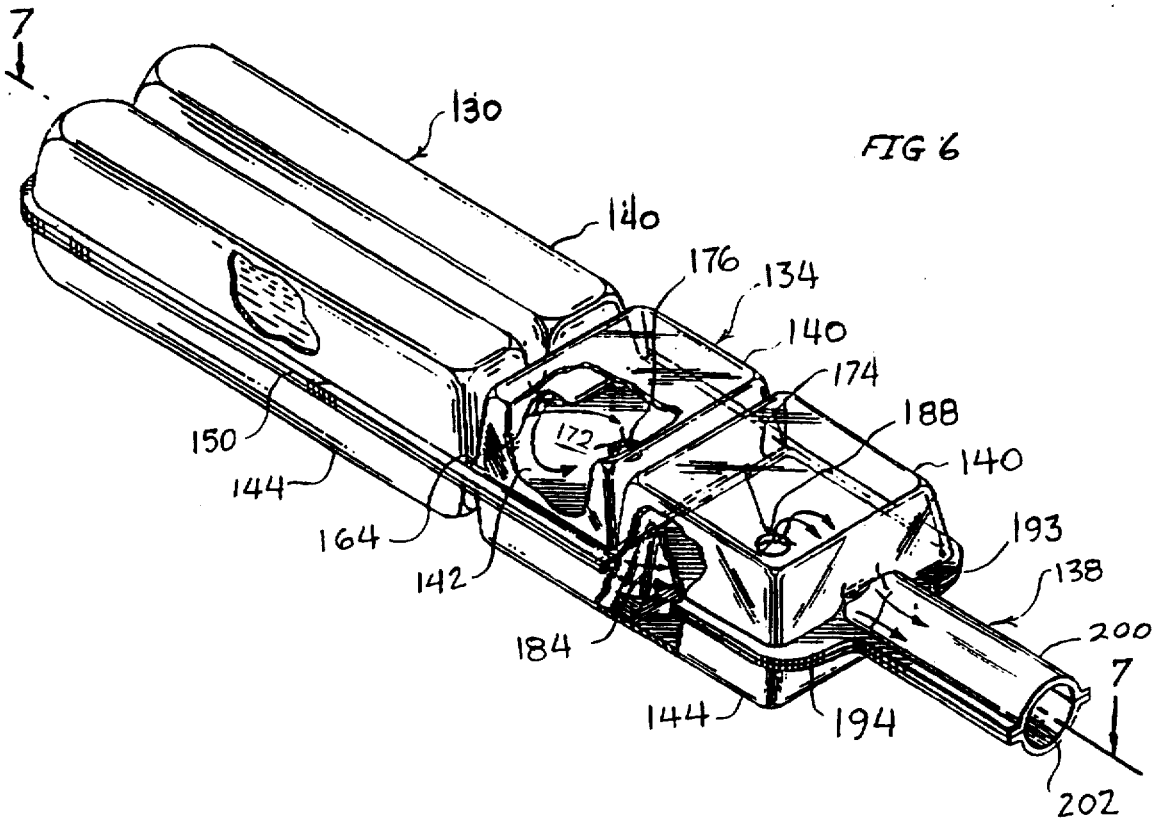

FIG 6

UNITED STATES PATENT AND TRADEMARK OFFICE

CERTIFICATE OF CORRECTION

PATENT NO. : 4,952,068

DATED : August 28, 1990

INVENTOR(S) : Theodore R. Flint

It is certified that error appears in the above-indentified patent and that said Letters Patent is hereby corrected as shown below:

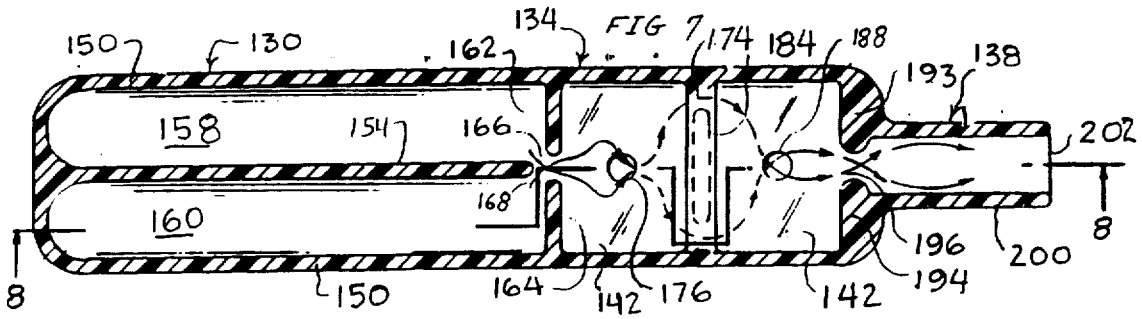

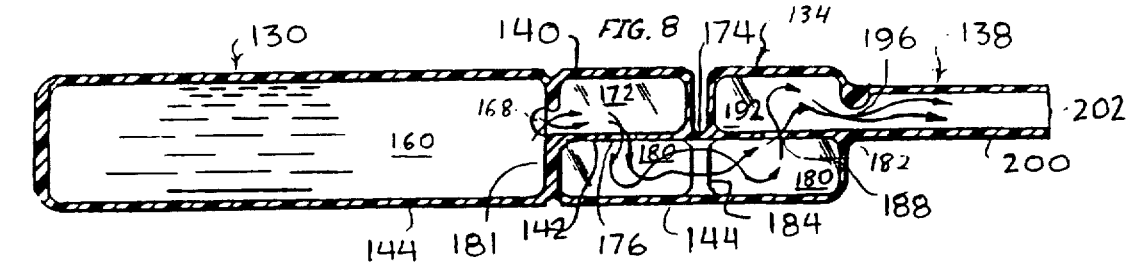

UNITED STATES PATENT AND TRADEMARK OFFICE

CERTIFICATE OF CORRECTION

PATENT NO. : 4,952,068

DATED : August 28, 1990

INVENTOR(S) : Theodore R. Flint

It is certified that error appears in the above-indentified patent and that said Letters Patent is hereby corrected as shown below:

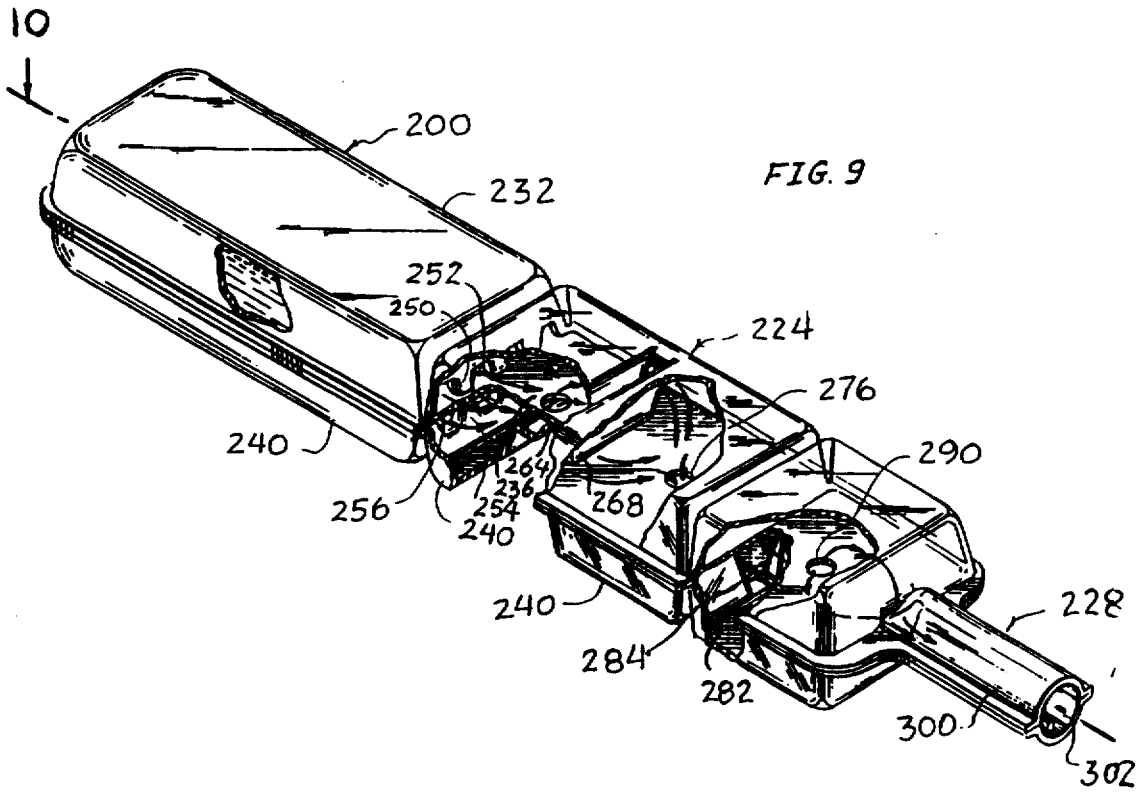

FIG. 9

UNITED STATES PATENT AND TRADEMARK OFFICE

CERTIFICATE OF CORRECTION

PATENT NO. : 4,952,068

DATED : August 28, 1990

INVENTOR(S) : Theodore R. Flint

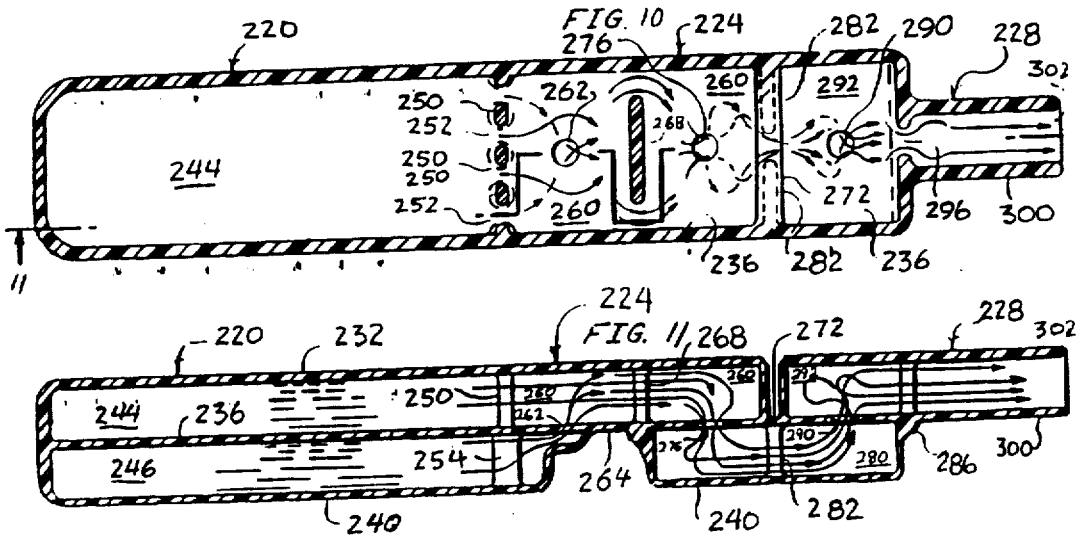

It is certified that error appears in the above-indentified patent and that said Letters Patent is hereby corrected as shown below: